US006343429B1

(12) United States Patent
Mossberg et al.

(10) Patent No.: US 6,343,429 B1
(45) Date of Patent: Feb. 5, 2002

(54) INERTIA-RESISTANT PREVENTER MECHANISM FOR FIREARM SAFETY ENHANCEMENT SYSTEM

(75) Inventors: Jonathan E. Mossberg, Branford, CT (US); George E. Kluwe, Ormond Beach, FL (US); Kevin F. Kinion, Port Orange, FL (US); Robert Safford, Delton, FL (US)

(73) Assignee: Mossberg Group, L.L.C., Daytona Beach, FL (US)

( * ) Notice: Subject to any disclaimer, the term of this patent is extended or adjusted under 35 U.S.C. 154(b) by 0 days.

(21) Appl. No.: 09/468,694

(22) Filed: Dec. 21, 1999

(Under 37 CFR 1.47)

Related U.S. Application Data

(63) Continuation-in-part of application No. 09/237,171, filed on Jan. 25, 1999, now Pat. No. 6,219,952.

(51) Int. Cl.[7] ..... F41A 17/00

(52) U.S. Cl. ..... 42/70.01; 42/70.05; 42/70.04; 89/142; 89/150; 89/154

(58) Field of Search ..... 42/70.01, 70.04, 42/70.05, 70.08, 70.11; 89/142, 148, 150, 154

(56) References Cited

U.S. PATENT DOCUMENTS

| | | | | | |
|---|---|---|---|---|---|
| 1,920,080 | A | | 7/1933 | Jenkins | 292/39 |
| 2,765,648 | A | | 10/1956 | Hatcher | 70/264 |
| 3,255,545 | A | | 6/1966 | Chambers et al. | 42/70 |
| 3,299,424 | A | | 1/1967 | Vinding | 343/6.5 |
| 3,316,810 | A | | 5/1967 | Angelos et al. | 89/28 |
| 3,396,999 | A | | 8/1968 | Knapp | 292/39 |
| 3,859,624 | A | | 1/1975 | Kriofsky et al. | 340/382 |
| 3,939,679 | A | | 2/1976 | Barker et al. | 70/277 |
| 4,003,152 | A | | 1/1977 | Barker et al. | 42/70 R |
| 4,132,439 | A | | 1/1979 | Miller | 292/144 |
| 4,154,014 | A | | 5/1979 | Smith | 42/70 R |
| 4,306,487 | A | * | 12/1981 | Beretta | 89/148 |
| 4,333,072 | A | | 6/1982 | Beigel | 340/825.44 |
| 4,467,545 | A | | 8/1984 | Shaw, Jr. | 42/70 R |
| 4,488,370 | A | | 12/1984 | Lemelson | 42/70 R |
| 4,784,415 | A | | 11/1988 | Malaval | 292/144 |
| 4,833,970 | A | * | 5/1989 | Wilhelm | 89/142 |
| 5,016,376 | A | | 5/1991 | Pugh | 42/70.11 |
| 5,062,232 | A | | 11/1991 | Eppler | 42/70.11 |
| 5,090,147 | A | * | 2/1992 | Pastor | 89/148 |
| 5,166,676 | A | | 11/1992 | Milheiser | 340/825.54 |
| 5,168,114 | A | | 12/1992 | Enget | 42/70.01 |
| 5,259,138 | A | * | 11/1993 | Scirica | 89/154 |
| 5,347,263 | A | | 9/1994 | Carroll et al. | 340/572 |
| 5,423,143 | A | * | 6/1995 | Martin | 42/70.01 |
| 5,448,847 | A | | 9/1995 | Teetzel | 42/70.01 |
| 5,461,812 | A | | 10/1995 | Bennett | 42/70.01 |
| 5,619,817 | A | | 4/1997 | Jones | 42/70.01 |
| 5,651,206 | A | | 7/1997 | Matarazzo | 42/70.08 |
| 5,673,560 | A | * | 9/1997 | Meller | 42/70.01 |

* cited by examiner

*Primary Examiner*—J. Woodrow Eldred
(74) *Attorney, Agent, or Firm*—Holland & Bonzagni, P.C.; Donald S. Holland, Esq.

(57) ABSTRACT

An inertia-resistant preventer mechanism is provided for use in a firearm safety enhancement system to reliably and selectably prevent or to unblock a firing mechanism of a firearm. The inertia-resistant preventer mechanism includes a first solenoid having a moveable blocking rod with a first actuation response speed. The blocking rod is normally interposed in the firearm to prevent activation of the firing mechanism and is selectably activated to unblock the firing mechanism. A second solenoid is also included, having a second blocking rod with a second actuation response speed equal to or faster than the response speed of the first solenoid. The second blocking rod of the second solenoid is normally interposed at an angle to the first solenoid to block the first blocking rod of the first solenoid against accidental unblocking caused by inertia and relative movement of the firearm. The second solenoid is selectably activated to unblock the first rod of the first solenoid substantially simultaneously with, or prior to, actuation of the first blocking rod to unblock the firing mechanism of the firearm.

17 Claims, 8 Drawing Sheets

INERTIA-RESISTANT PREVENTER MECHANISM FOR FIREARM SAFETY ENHANCEMENT SYSTEM

This is a Continuation-in-Part of application Ser. No. 09/237,171, filed Jan. 25, 1999 now U.S. Pat. No. 6,219,952.

FIELD OF THE INVENTION

This invention relates to firearm safety devices, and more particularly, to mechanisms for preventing accidental firing of a partially electronically controlled firearm.

BACKGROUND OF THE INVENTION

As society has moved further and further from rural, agricultural and hunting population bases towards urban population centers, there has become a greater and greater concern for firearm safety. Of particular concern are incidents of improper handling of firearms by unsanctioned individuals that lead to disastrous results.

Also, firearms have traditionally been advantageous, when properly understood and used, for protection against would be perpetrators of crimes against the property, homes, family and person of law-abiding citizens ("More Guns, Less Crime"—Professor John R. Lott, Jr. 1996, University of Chicago). Yet there is a concern that firearms may be accessed by unauthorized individuals or children. Further, there have been instances in which citizens and police have had their firearms taken from them by intruders, suspects and criminals who then use the firearm against the rightful owner. Thus, there is a need to reduce such incidences of accidental or intentional access by unauthorized persons and children and there is a need to reduce instances of firearms taken from individuals and police officers to be used to assault the individuals or police officers.

As one of the safeguards of our freedom, the Constitution of the United States grants every lawful citizen the right to bear arms. At the same time, however, general access to firearms necessitates societal responsibility to ensure that incidents of gun injury are minimized. Thus, there are two simultaneous needs: the need for free people to own firearms if desired and a need to promote safety through education and by offering the choice of additional safety enhancement features to those who may benefit from them.

Many safety devices for firearms have been proposed in the past. However, a device that adequately addresses the personalization of a firearm has not been devised prior to the present invention. For example, safety devices using mechanical keys have been devised; however, keys require keeping track of the key and locating the key before using the firearm. In times of fear or panic, the act of inserting the key prior to operation can lead to difficulties and inability to use the firearm for protection in an emergency. The firearm, once activated with the key, can be taken from the rightful owner and continued to be used as long as the key remains inserted. This does not address many of the concerns regarding firearms to be used for protection or that might be taken away from the rightful user.

Another previously proposed safety mechanism requires mechanical manipulation to cause certain slides and levers to be moved into proper position for allowing firing. Although the requirement that the owner must learn and use certain complex movements, providing a modicum of additional safety, it nevertheless also interferes with prompt use for defense purposes. Also, once the movements become generally known, anyone having this knowledge may use the firearm. Moreover, the risk of accidental "successful" manipulation of the device by a child continues to exist.

Magnetically activated switches or magnetically moveable slide mechanisms for blocking the firing mechanism have also been proposed. However, devices that do not discriminate as to the strength of the magnet required can be activated by anyone having a magnet.

Magnetically activated switches having a particularly selected magnetic strength range have also been proposed. Such devices successfully permit only an individual having the proper strength magnet on a finger ring to operate the firearm. It has been found that such devices are useful for a limited number of selected field strength ranges and thus to distinguish between those without magnets and an individual user having a magnetic ring with the appropriate strength. These devices act quickly in emergency defensive use situations, but nevertheless face some drawbacks with respect to the limited number of selectively distinguishable strength ranges for magnets.

Handprint and fingerprint identification devices have been proposed in which the grip of the firearm has sensors that are connected to a microprocessor to detect distinctive prints of an authorized user. However, the power requirements are significant and tend to prevent practical usage. Also, the complexity, the reliability and the sophistication of the computerized identification of handprints and fingerprints have made this proposed solution very expensive and impractical for wide-scale adoption. Fingerprint identifications are likely to fail when the grip is wet with rain, condensation or another liquid or when hands are wet, sweaty, dirty, greasy or otherwise soiled or when gloves are worn. Any or all of these factors could be present when use of the firearm is appropriate by a peace officer, the rightful owner or another properly authorized individual.

Personal identification of an authorized user through radio transmission of a coded signal from a user to a transceiver has also been proposed. Such a device, however, requires both an adequate power supply mounted in the firearm for operating the transceiver and the safety mechanism and also an adequate power carried by the user supply for operating the transponder or transmitter carried by the authorized user. Moreover, radio transmission and reception generally requires an antenna having a length equal to one-fourth of a wavelength. Thus, for frequencies lower than the gigahertz range the transponder can be quite large. To date, this proposed solution has been impractical and has not been successfully implemented for commercial applications. Some of the problems include the onboard power supply being continuously drained while awaiting receipt of authorized radio signal transmission. Also the transmitter/transponder carried by the authorized user must have an adequate power supply. The risk is significant that the battery power of a stored firearm will become depleted and will thereby prevent use of the firearm by the authorized user at inopportune times. No one wants to be looking for and replacing batteries when an intruder invades their home. Further, the personalized transmitter/transponder can be larger than an ordinary ring in order to accommodate an adequate antenna size or to provide adequate power for continuous availability of the firearm for use. Radio transmission also typically provides for reception distances of more than a few feet, which is generally sufficient for close range use of a firearm against the authorized user. This is not acceptable for situations where a police officer might have a firearm wrested away in a scuffle with a suspect. Also traditional radio frequency signals are subject to many types of outside interference. For example high voltage noise, other radio broadcast, large transformers, certain electronic equipment and even lighting. Even sun spots have been suspected to have caused radio controlled garage doors or other radio controlled equipment to open.

Another device shown in U.S. Pat. No. 5,564,211 provides for a directional radio signal wherein the authorized user has a transmitter and the firearm has a receiver. The receiver is designed to deactivate the firearm whenever the directional radio signal indicates that the firearm is pointed at the individual having the authorized radio transmitter. Such a device is clearly useful for certain purposed as it is designed to reduce the risk of a firearm being used against a rightfully authorized user. Once again, these devices have significant power requirements, both for the receiver and the transmitter, so that they suffer from some of the drawbacks as with some of the other prior radio coded devices.

Voice identification and voice activation firearm safety devices have also been proposed. Problems arise with properly programming voice identification or other voice command activation signals so that such signals cannot be duplicated by others. The complexity of computerization using microchips and/or software that is required for voice identification continues to challenge currently available technology and is still very costly. The solution is not yet practical. The power requirements are still problematic. Also, the need in certain situations, particularly hunting and police work, to quietly activate a firearm without talking or without another audible signal, further tends to make this proposal less than adequate.

An electromagnetic solenoid blocking mechanism has become popular among proposed safety devices since it was first suggested in U.S. Pat. Nos. 5,016,376 and 5,123,193. Safety devices for use with electronic firing firearms have been proposed as an alternative to mechanical or electromechanical blocking of firing mechanisms of firearms. Such alternative devices might avoid some requirements for mechanically or physically blocking the trigger or firing mechanism that has been suggested for most proposed firearm safety devices. The proposed alternative electronic firing devices are complex and the technology for electronic firing is not yet available as a commercially feasible product. Moreover, electronic firing also continues to require a personal identification system that is sufficiently selective, and sufficiently reliable with adequate power and that previously has not been adequately addressed.

SUMMARY OF THE INVENTION

Thus, a need has been identified for a firearm safety system that is reliably enabled only by an authorized individual. The need is one for a device providing close proximity activation by a conveniently small personal identification device, preferably an adornment, held, carried or worn unobtrusively at a location on the individual that is brought in close proximity to a firearm when it is used, such as an unobtrusive piece of jewelry or a finger ring. It is desirable that the identification adornment be one that can be worn continuously for purposes of police work and for sport shooting, hunting and personal protection. One should be able to sleep with the adornment on so that nighttime home protection is a practical option. The safety enhancement mechanism should operate automatically and reliably without interfering with other existing manually operated safety mechanisms already present on most firearms. The system should provide for a large number of different personal identification codes. The device should be factory programmable and preferably factory re-programmable so that, in the event that the identification device is lost or stolen, the firearm can be reprogrammed for use with a replacement identification device or adornment and so that the firearm cannot be operated by another having possession of the previously lost or stolen identification adornment. Advantageously the device should not be programable by individuals. Unsanctioned users and children should not be able to reprogram the system to make themselves authorized users. The needed safety enhancement device should also provide a reliable power source portably carried with or in the firearm so that the identification device or adornment does not require its own separate power supply and can therefore be made small and convenient to carry and preferably continuously wearable.

The portable power supply should reliably warn the user when the power is low; but should continue to operate reliably until the warning is heeded and the power supply is replenished.

The mechanism used to prevent and selectively enable firing should be resistant to inertia due to rapid movements of the firearm to increase reliability of the enhanced safety system.

The foregoing and other objects and advantages have been accomplished and provided in the firearm safety enhancement system and device of the present invention. The invention provides a "preventer" for preventing firing of a firearm without power being applied. It is provided with a reliable portable battery power supply. A proximity or system "on" switch connects the power supply to an interrogation circuit when a personal identification device is in close proximity to the interrogation circuit or simply when a user handles the firearm. The interrogation circuit electromagnetically checks the immediately surrounding environment for an authorized personal identification code stored in the personal identification device. The personal identification device is secured in a small personal adornment carried or worn by the authorized user, preferably, the adornment may be a finger ring, or other small unobtrusive piece of jewelry, that is automatically brought into close proximity to the firearm when it is to be used. Preferably, the personal identification device comprises a passive tag that is programmed with an individual identification code. The passive tag advantageously receives power transmitted from the firearm in the form of an electromagnetic wave or power signal. The passive tag receives and is activated by the power signal from the firearm in the form of electromagnetic energy. Upon activation, the passive tag provides a coded return signal corresponding to the personal identification code. The coded signal is read by a reader circuit in the firearm. When the code provided by the identification tag matches a preprogrammed code stored in the reader circuit, the reader circuit acts to retract the preventer mechanism so that operation of the trigger and firing of the firearm is enabled. With the firearm thus enabled, the authorized user can then choose to pull the trigger and discharge the firearm.

Thus, what has been provided is a firearm safety enhancement system comprising at least one preventer, preferably a preventing solenoid, operatively connected in the firearm. The preventer has a blocking position to prevent firing and a firing position to allow firing. An electrical activation circuit is operatively connected to the preventer to move the preventer between the blocking position and the firing position. A portable power supply is held in the firearm and is coupled to the electrical activation circuit for providing electrical power. A power signal transmitter is mounted in the firearm, coupled to the portable power supply for transmitting an electromagnetic power signal. A passive identification tag is mounted in a small adornment, such as a small piece of jewelry, and preferably a finger ring. The passive identification tag is responsive to the electromagnetic power signal transmitted from the firearm and becomes energized upon receiving power therefrom. Upon receiving power from the power signal, the passive tag activates a return signal carrying a personalized identification code preprogrammed into the microcircuitry of the passive tag. A reader circuit is provided in the firearm that is responsive to the personal identification signal to activate the electrical activation circuit only upon detecting a personal identification code that matches an authorized code stored in the reader memory. When the matching code is detected, power from the portable power supply is connected by the activation circuit to the preventer causing it to move from the prevented position to the unblocked position. When the firing mechanism is unblocked, and assuming any other mechanical safety is also off, the firearm can be fired by the authorized user.

According to another aspect of the invention, the power signal transmitter includes an electrical current oscillating circuit connected to a magnetic field-generating transmission coil. The magnetic field-generating coil preferably comprises an electromagnetic core having low hysteresis characteristics. The core is wrapped with a small coil of conductive wire. In one preferred embodiment, this power signal transmission coil acts as a primary coil of a transformer. An oscillating magnetic field is generated by passing an oscillating or alternating electrical current through the coil. The magnetic field oscillates, changing polarity at the same frequency as the oscillating current, and thereby produces a power signal that is transmitted through the electromagnet. An oscillating frequency that is lower than typical radio frequency transmissions, preferably a frequency in the range of kHz and megahertz and more, preferably in the range of about 50 kHz to about 20 MHZ and most preferably at a frequency of about 125 kHz is used according to one aspect of the invention. The passive tag similarly includes an electromagnetic coil including a small core and a small coil of conductive wire wrapped therearound. In the embodiment where the power transmitter acts as a primary transformer coil, the coil in the tag acts as a secondary transformer coil. The coil in the tag receives the electromagnetic energy when in close proximity to the power transmitting coil in the firearm. In the described embodiment, the power transmitter and the tag act together like a loosely coupled transformer. Close proximity is required for adequate power transmission to the tag. The power is appropriately received in the tag to provide a remote power source to the tag circuitry. The power signal is also preferably divided and used as a clock pulse to the circuit for producing a coded signal in the tag that is communicated back to a reader circuit that reads and decodes the coded signal to determine whether the code is that of an authorized user.

According to one advantageous embodiment, the personal identification code is preprogramed into the passive tag and the tag circuit periodically shunts (i.e., partially short-circuits) the tag coil according to a preprogrammed code in the circuit. The electromagnetic power transmission between the transmitter coil and the tag coil acts as a loose coupled transformer so that the periodic shunting of the tag coil periodically and simultaneously (i.e., at the speed of light) changes the voltage of the electrical current flowing through the power transmission coil of the transmitter. Thus, the power signal becomes a carrier signal using a signal backscatter phenomena. The change in the voltage across the primary coil caused by the shunting of the secondary coil in the identification tag corresponds to the personal identification code stored in the tag. The changes in voltage are "read" by a reader circuit connected to the power transmitting coil as by using a peek voltage detection circuit. The changes in voltage are converted to a digital code that is then compared to a code programmed or otherwise stored in memory in the reader circuit. If the code imposed by the tag and carried back to the reader on the power transmission signal corresponds or matches the prerecorded code in the reader memory circuit, the activation circuit effectively acts to connect the preventer to the power supply, thereby unblocking the firing mechanism.

According to another aspect of the invention, the power transmission circuit is switched "on" to send out a power transmission signal only when a switch is actuated in the grip or stock of the firearm. The power signal transmission "on" switch is preferably activated only when the adornment in which the passive tag is carried is in close proximity to the firearm. This preserves the energy supply in the portable power supply, using current only when the passive tag is in the proximity of the firearm.

An additional feature to preserve power, is that once the reader circuit reads and confirms the identification of an authorized user code, the preventer is actuated to enable the firing mechanism and the power transmission circuit discontinues transmitting the power signal. The interrogator circuit no longer searches for the passive tag and the authorized code programed therein. The preventer is simply maintained in the enabled firing position as long as the "on" switch is turned on.

According to another alternative embodiment of the invention, the power transmission circuit is periodically switched "on" to send out a power transmission signal to determine whether a passive tag is in close proximity to the grip or stock of the firearm. The power to the enabling circuitry is preferably activated when the adornment in which the passive tag is carried is in close proximity to the firearm. This preserves the energy supply in the portable power supply, using current sparingly and periodically to interrogate the surroundings and otherwise only when the passive tag is in the proximity of the firearm.

According to a firther aspect of the invention the preventer mechanism is made resistant to inertia that might cause relative movement of the internal parts of the preventer mechanism and inadvertently enable the firing mechanism due to rapid changes in movement direction of the firearm. A pair of angularly-oriented solenoids are used as the preventer to block the firing mechanism. Advantageously, a first solenoid is positioned for axial reciprocation of a blocker rod back and forth in one axial direction to block or to release the firing mechanism and a second solenoid is positioned for axial reciprocation of a second blocker rod in another axial direction, the second axial direction being at an angle to the first solenoid and at a location to prevent movement of the first blocker rod of the first solenoid. Both solenoids must be actuated away from their normal blocking positions to allow the user to fire the firearm. The angular relationship prevents inadvertent rapid change in movement direction of the firearm from moving the blocker rod of the preventer solenoid by inertia to unblock the firing mechanism. This arrangement reduces any chances of actuation caused by inertia movement of internal parts of the preventer mechanism, as by bumping, thrusting or shaking the firearm in the axial direction of the solenoid. The second solenoid is positioned in an angular relationship to the first solenoid so that inertia movement of the blocker rod of either preventer solenoid in one axial direction does not simultaneously result in inertia movement of the blocker rod of the other solenoid. An angular relationship approximating a right angle (about 90 degrees) is beneficial for this purpose. Still, much of the benefit might be obtained with different angles where available space inside of the firearm might require a different angular relationship. The likelihood of a firearm being rapidly jarred with sufficiently rapid acceleration in the precise direction of even a single solenoid (i.e., axial aligned jarring with adequate violence to move a spring-loaded blocker rod of a spring-loaded solenoid to an unblocked position) and at the same time that the user is pulling the trigger, is remote. Nevertheless, this unique dual-angled solenoid preventer arrangement advantageously reduces even further any remote chances of inadvertent mishap due to mishandling of the firearm.

According to another aspect of the present invention, the portable power supply includes a primary battery having a predetermined nominal voltage and a backup battery having the same predetermined nominal voltage. A backup circuit is connected to detect when the voltage in the primary battery falls below a predetermined minimum voltage level. Upon detection of such minimum voltage, the backup circuit couples the backup battery to the safety system. The user is signaled when the backup battery has been connected in the circuit so that battery replacement can be effectuated. The signaling mechanism may, for example, be an audible, periodic beeping signal. A timed interval between beeps might be about every one to five minutes. The signal advantageously continues as long as the backup battery is connected so that the user is continuously warned to replace the primary battery. The safety enhancement system continues to operate using the backup battery power. The user can thereby avoid situations of inability to use the firearm due to a low battery. Beneficially, the primary battery may comprise two batteries in parallel to provide maximum primary battery power and extended battery life. Also, preferably lithium batteries are used for their extended life characteristics.

According to yet another aspect of the present invention, a power conservation circuit is provided by which the power to the preventer solenoid mechanism is reduced following a specified time period after the solenoid is initially activated into a firearm usage or unblocked position. Solenoids require less current to maintain the actuated rod in the actuated position than is required for initial actuation. Thus, carrying the firearm for a prolonged period in the "on" or ready-to-use condition with the firing mechanism unblocked does not consume power at the same rate that power is consumed in order to initially activate the solenoid. In a preferred embodiment, this power conservation circuit periodically pulses short bursts of high current with a minimum maintenance current provided between bursts. Thus, in the event that the solenoid inadvertently moves to the preventing position while it is powered with the lower current sufficient only to maintain its position, the periodic pulse of high current will return the solenoid to the unblocked position without reinitializing the entire system.

According to a further aspect of the present invention, the power transmission circuit provides an electromagnetic power signal in the form of an oscillating magnetic field at a predetermined low frequency. A system using components designed for use at 125 kHz has been found to be useful. The magnetic tag of the personal identification device imposes a backscatter signal onto the power transmission signal. The backscatter signal provides an analog version of the personal ID code. Advantageously, a frequency shift keying (FSK) coding system has been found to be useful and to reliably provide a coded return signal representing the personal ID code. The FSK coding system is very reliable and is resistant to minor fluctuations or field interruptions. In the FSK system, the tag coil is periodically shunted (partially short-circuited through a transistor across the coil terminals) and then unshunted (i.e., open circuited) at frequencies lower than the frequency of the power signal from the transmitter primary coil. For example, the secondary coil is unshunted and then shunted for a first number of cycles of the primary power signal to represent the binary number "0." Then the secondary coil is unshunted and then shunted for a second number of cycles to represent the binary number "1." In a specific example, eight unshunted cycles and eight shunted cycles correspond to the number zero and ten unshunted cycles and ten shunted cycles correspond to the number one in a binary code system. Thus, eight full voltage cycles of the power transmission signal followed by eight shunted cycles at a lower voltage (a 60 db drop can be reliably detected) corresponds to the number zero, and ten full voltage cycles followed by ten shunted cycles corresponds to the number one. The sequence of zeros and ones represents the personal identification code. The number of bits of memory determine the number of possible different identification codes. A binary code is therefore imposed on the power transmission signal, which power signal, according to the backscatter phenomenon, acts as a carrier signal for the return coded signal according to the code programmed in the passive tag. The use of the frequency shift key system provides reliable data transmission because it is resistant to "noise" interference from other electromagnetic field sources.

According to another aspect of the invention, a small microchip forms a part of the magnetic tag. Inexpensive microchips smaller than a few square centimeters are available with many bits of programmable storage information. For example, a microchip having capability of 96 bits of information is sufficiently small to fit on or inside a finger ring. The 96 bits of information can be sequentially arranged into a large number of recordable individual codes. For example, the code and the reader may be designed so that some of the available bits signal the start position for cycling through the code in proper sequence. Each signal to shunt the tag coil may be made of four bits, one of those bits may convey parity information and three bits may convey the shunt timing, i.e., eight cycles or ten cycles. The 96 bit sequence therefore may represent about $8^{22}$ different possible ID codes that could be separately preprogrammed or stored on any authorized user identification device.

According to yet another aspect of the invention, the code reader circuit in the firearm safety device is programmable. To program the system, it is turned on to transmit a power signal. A programming tag prerecorded with the secret programming code and that is preferably maintained and secured only at the manufacturing facility, is placed in the vicinity of the reader so that the reader reads the special programming code. The reader of every system is preprogrammed to recognize the special programming code and to respond to the code by putting the reader into a programming mode. Before turning the reader off, a personal ID-coded ring having the personal identification code to be authorized for use is then placed in the vicinity of the reader. In the programming mode, the reader records the code of the ring as an authorized code. When programming is completed, the ring carrying a passive tag having that authorized programmed code will activate the firearm from the prevented position to the unblocked firing position. The firearm can be reprogrammed, preferably only at the factory where the secret programing tag is secured, to authorize a different code using the same mechanism. The first code could be overwritten and made unauthorized.

According to another further aspect of the invention, the code reading circuit has a circuitry for recording a plurality of codes when in a programming mode, so that more than one personal identification code could be authorized for the same firearm. Upon the loss of any one of the authorized coded tags, the firearm could be reprogrammed to eliminate authorization of the lost code, thereby preserving the security of the firearm system.

BRIEF DESCRIPTION OF THE DRAWINGS

These and other objects and advantages will be more fully understood with reference to the detailed description of the preferred embodiment, the claims, and the drawings in which like numerals represent like elements and in which:

DETAILED DESCRIPTION OF THE PREFERRED EMBODIMENTS

Figure 1:
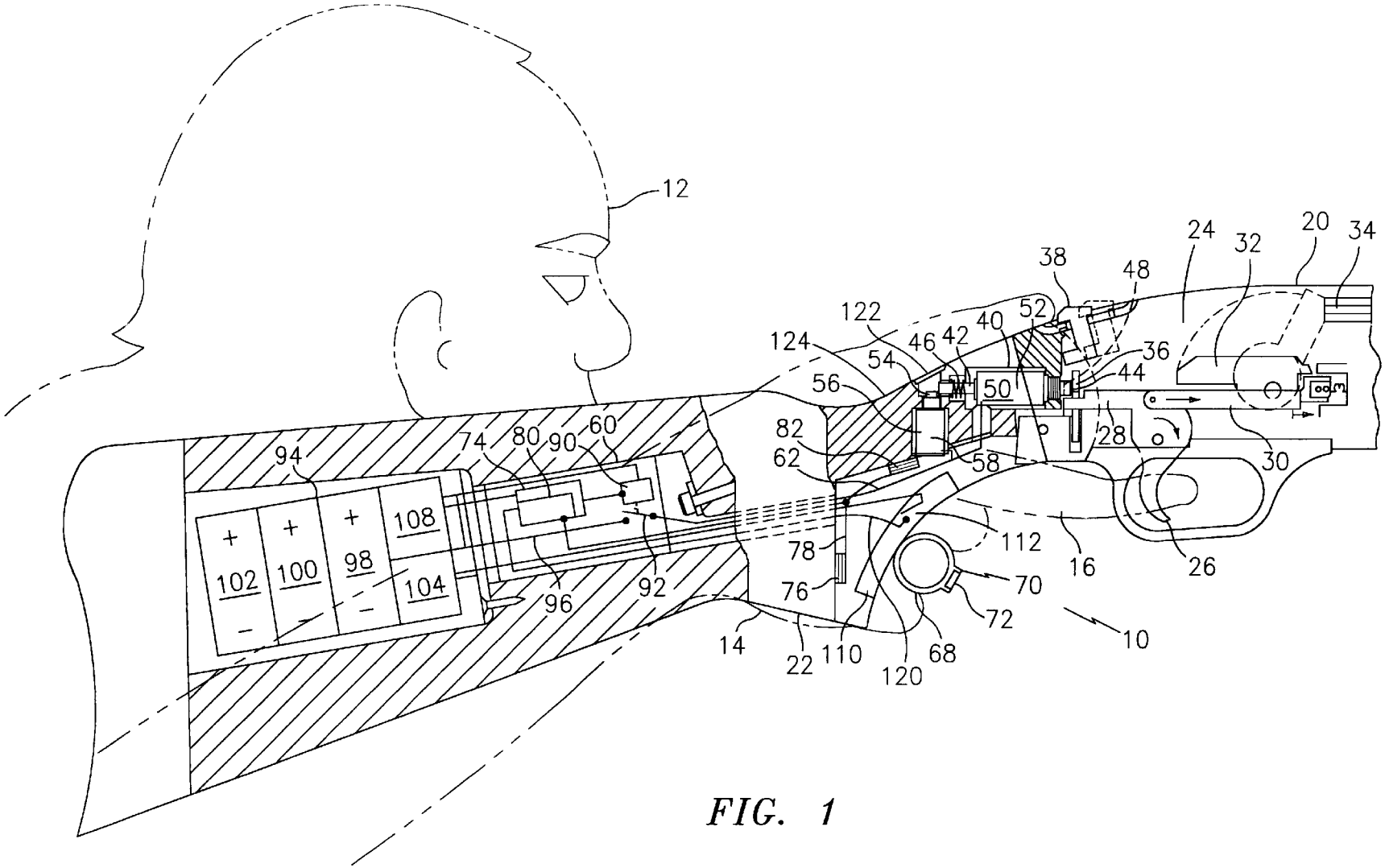
FIG. 1 is a schematic side section view of the grip or the stock of a firearm and personal adornment comprising a safety enhancement device and system according to the present invention and further depicting a user positioned for use of the firearm in phantom lines.

FIG. 1 schematically depicts a safety device and system 10 mounted in a firearm 20 depicted in a partial side view cross-section showing an individual 12 (depicted in phantom line) with the individual's hand 14 (also in phantom line) in place on the grip or stock 22 of the firearm. The individual's hand 14 is depicted in a normal grasping position for pulling a trigger 26 for actuation of a firing mechanism 24. The firing mechanism 24 may, for example, include a trigger 26 that it is pivoted upon pulling, as with a trigger finger 16, by a conscious effort of the individual 12. Pulling trigger 26 simultaneously raises a safety lever 28 and moves a hammer release 30 forward to disengage a spring-loaded hammer 32. Upon release, the spring-loaded hammer 32 rotates rapidly to impact against a firing pin 34. In the embodiment depicted, a safety bridge 36 is slidably held in a vertical slot for movement by the safety lever 28, that pivots upward upon pulling the trigger. A mechanical safety 38 is also provided that is slidable between firing position and a safety position. In the embodiment depicted, when the mechanical safety 38 is slid to a rearward position, it physically engages safety bridge 36 and blocks movement of the safety lever 28, preventing movement of the safety lever 28 which stops movement of the trigger and thereby prevents releasing the hammer 32. Only upon sliding the mechanical safety 38 to a forward position (depicted in dashed lines) can the hammer release 30 move forward to release the hammer 32.

The firing mechanism depicted in FIG. 1 is an arrangement consistent with the design of some existing firearms and is only one example of a firearm firing mechanism for which the invention of useful. Most firing mechanisms for firearms include a trigger, similar to the trigger 26, that releases a hammer, similar to the hammer 32, to cause a firing pin, similar to the pin 34, to impact against loaded ammunition, thereby igniting a charge so that a projectile is discharged from the firearm. Typically, the loaded ammunition is a cartridge having a gunpowder charge and a projectile or a plurality of projectiles, as in a shotgun shell. Center-fire cartridges or rim-fire cartridges (not shown) are typical types of ammunition. Some newly-proposed firearms include electrical or laser ignition of a propellant in a cartridge to cause a projectile to move rapidly and to be discharged from the barrel of the firearm. Certain principles of the present invention may be useful to increase safety and to reduce unauthorized firing with both mechanical hammer-activated firearms and also other newly proposed electrical or laser-activated firearms, as will be discussed more fully below.

According to the present invention, as depicted in FIG. 1, a "preventer" mechanism 40 for preventing the firearm from firing is secured in the firearm grip or stock 22. The preventer mechanism 40 shown in FIG. 1 has a first blocker rod 42 with a first position 44, or a safety position 44 (depicted in solid lines) at which the firing mechanism 24 is prevented from firing. In the embodiment depicted, the preventer mechanism 40 comprises a first solenoid 50 having a first blocker rod 42 that is electromagnetically moveable along a first axial direction 52. The preventer mechanism 40 is connected to an electrical activation circuit 60 by which blocker rod 42 can be actuated to move from the safety position 44 to a second nonblocking or firing position 48. The first blocker rod 42 is biased with a biasing device 46, schematically depicted in FIG. 1 as a spring 46. Thus, the first blocker rod 42 of the preventer mechanism 40 is held in the safety position so that pulling on the trigger 26 will not cause the firearm to discharge; the trigger is prevented from moving. The firing mechanism is effectively blocked, even though the mechanical safety 38 might be moved to an "off" safety position.

The electrical activation circuit 60 is electrically connected to the preventer 40 via a conductor 62. One of the key aspects of the invention is that the preventer mechanism 40 is moved to an unblocked position only upon identification of an authorized user 12. The authorized user 12 wears or otherwise carries an identification adornment 70, such as a finger ring 68, having a passive tag unit 72 that is placed by the user next to the firearm in an appropriate close proximity location, such as at the grip 22 of the firearm 20, so that an interrogation circuit 74 coupled to the activation circuit may check the immediately-surrounding environment for an authorized code in the personal identification device 70.

Uniquely and advantageously, the personal identification device 70, according to the present invention, holds a passive tag unit 72 that does not require its own onboard power supply. Rather, the passive tag unit 72 receives power from a power signal transmitter 76 that is coupled through electrical conductor 78 to a power signal-generating circuit 80 that may be included in the interrogation circuit, as depicted schematically in FIG. 1, or that might be a separate circuit coupled to the interrogation circuit 74. The interrogation circuit 74, with its power signal generating circuit 80 having at least one power signal transmitter 76, may further include one or more additional power signal transmitters 82 so that the passive tag unit 72 may receive sufficient power, either from a power signal from the power transmitter 76 or another power signal from the additional power transmitter 82, both of which power signals are identical, both being provided by the same power signal-generating circuit 80. As will be discussed in greater detail below, the passive tag 72 receives the power transmitted from the firearm in the form of an electromagnetic wave that comprises one or both of the power signals. Upon receiving the power, the passive tag 72 is activated by the power signal and, upon activation, provides a coded return signal corresponding to a preprogrammed personal identification code unique to the particular passive tag and, thus, the to identification device in which the passive tag unit is secured. The return signal corresponding to the personal identification code is read by a reader circuit 90 that is part of the interrogation circuit 80 mounted in the firearm. When the code of the coded return signal provided by the identification device matches a preprogrammed code stored in the reader circuit 90, the reader circuit 90 acts to cause the preventer 40 to move to its second unblocked position so that the operation of the trigger and firing of the firearm is permitted. It will be noted that if the pre-existing mechanical safety 38 remains in a safety "on" position, firing will not be permitted, even though the interrogation circuit detects an authorized code passive tag in proximity to the firearm. Thus, the inventive safety system does not override the existing safety 38 but, rather, supplements the existing safety 38.

Figure 2:
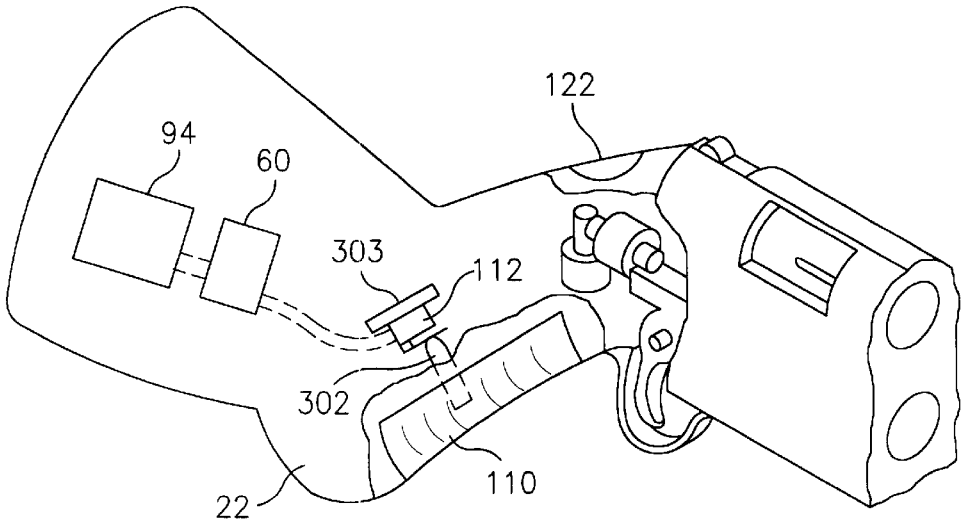
FIG. 2 is a schematic front, partial cutaway of the grip or stock of a firearm schematically depicting an arrangement of internal components, including a view window for observing whether a preventing mechanism is activated and a grip lever and grip switch.

Upon interrogation of the surrounding environment (including transmitting a power signal, the passive tag being activated by the power signal to return an identification-coded signal, reading the identification-coded signal and comparing it to a preprogrammed stored code), the reader circuit 90 signals the electrical activation circuit 60 to connect as at a schematically represented switch 92, power from power supply 94, as along conductor 96 through actuation conductor 62 and to the preventer 40, thereby causing the preventer 40 to move from its safety position 44 to a power actuated firing position 48. The onboard power supply 94 may comprise at least one electrical storage battery 98. In the preferred embodiment, power supply 94 comprises a first battery 98, a second battery 100 and a third backup battery 102. Batteries with high energy storage capabilities, such as lithium manganese dioxide that are generally referred to as "lithium" batteries, have been found to be advantageous for the present purposes over other currently known batteries that do not last as long, that may loose power during non-use or that require periodic recharging and the inconvenience associated with recharging. Other types of batteries currently known or later developed might nevertheless be used within the scope and according to other aspects of the invention. First and second batteries 98 and 100 form a primary power source 94. The primary power source 94 and the backup battery 102 are coupled together and to the safety system 10 as with a backup power circuit 104. The backup battery circuit acts to check the voltage in from the primary batteries and when the voltage in the primary power supply 94, i.e., in batteries 98 and 100, falls below a predetermined minimum voltage in a range of voltages that provide reliable activation of preventer 40 the backup circuit connects the backup battery to transmit power to safety system 10. Preferably, the primary power source 94 is disconnected at the same time, or shortly thereafter, to avoid having low voltage primary batteries drain power from the backup battery. These circuits may be formed on separate boards such as separate printed circuit boards, schematically depicted in FIG. 1, or they may be formed on the same circuit board as with the electrical activation circuit 60 and other circuits, as schematically depicted in FIG. 2, yet described here according to separately identifiable features.

To further conserve energy, an energy saving circuit 106 (see FIG. 3) is used to reduce the amount of power consumed by preventer 40 to maintain the preventer in the unblocked position. This circuit may also be formed on a separate board or integrally formed on a board with one or more other components.

One advantageous feature of the present invention is that the interrogation for the authorized user identification device 70 is only in a small area in close proximity to the firearm. This feature is accomplished with the interrogation circuit 74 and at least one power signal transmitter 76 providing an electromagnetic power signal having a limited range. In a second instance, according to another aspect of the invention, the interrogation of the authorized user identification device 70 is carried out when a grip switch lever 110 is depressed to activate a grip switch 112 or other system switch. Such a grip switch and lever is shown in FIGS. 10 and 11.

Figure 10:
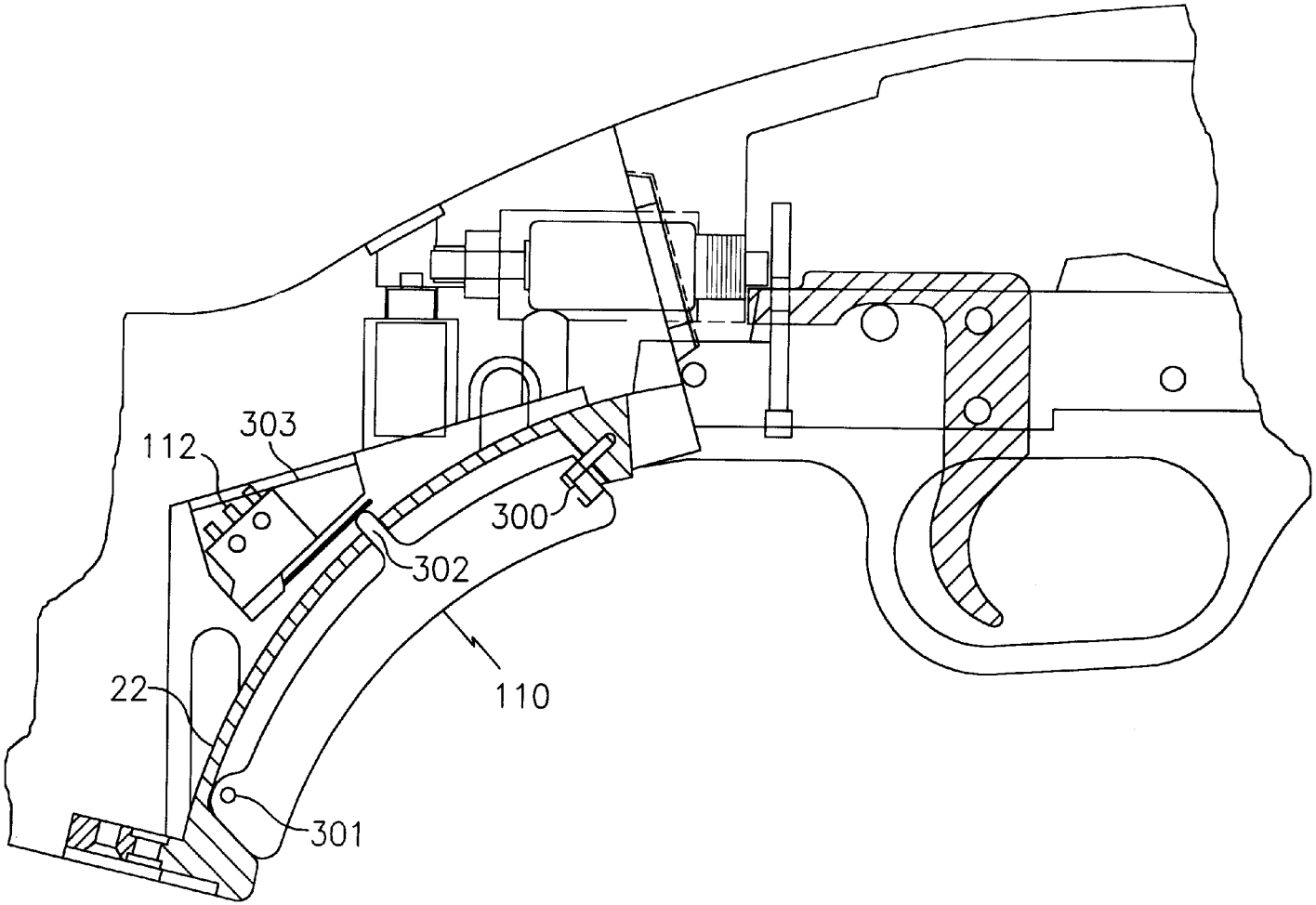
FIG. 10 is a schematic side section view of a first grip lever and switch arrangement according to the present invention.
Figure 11:
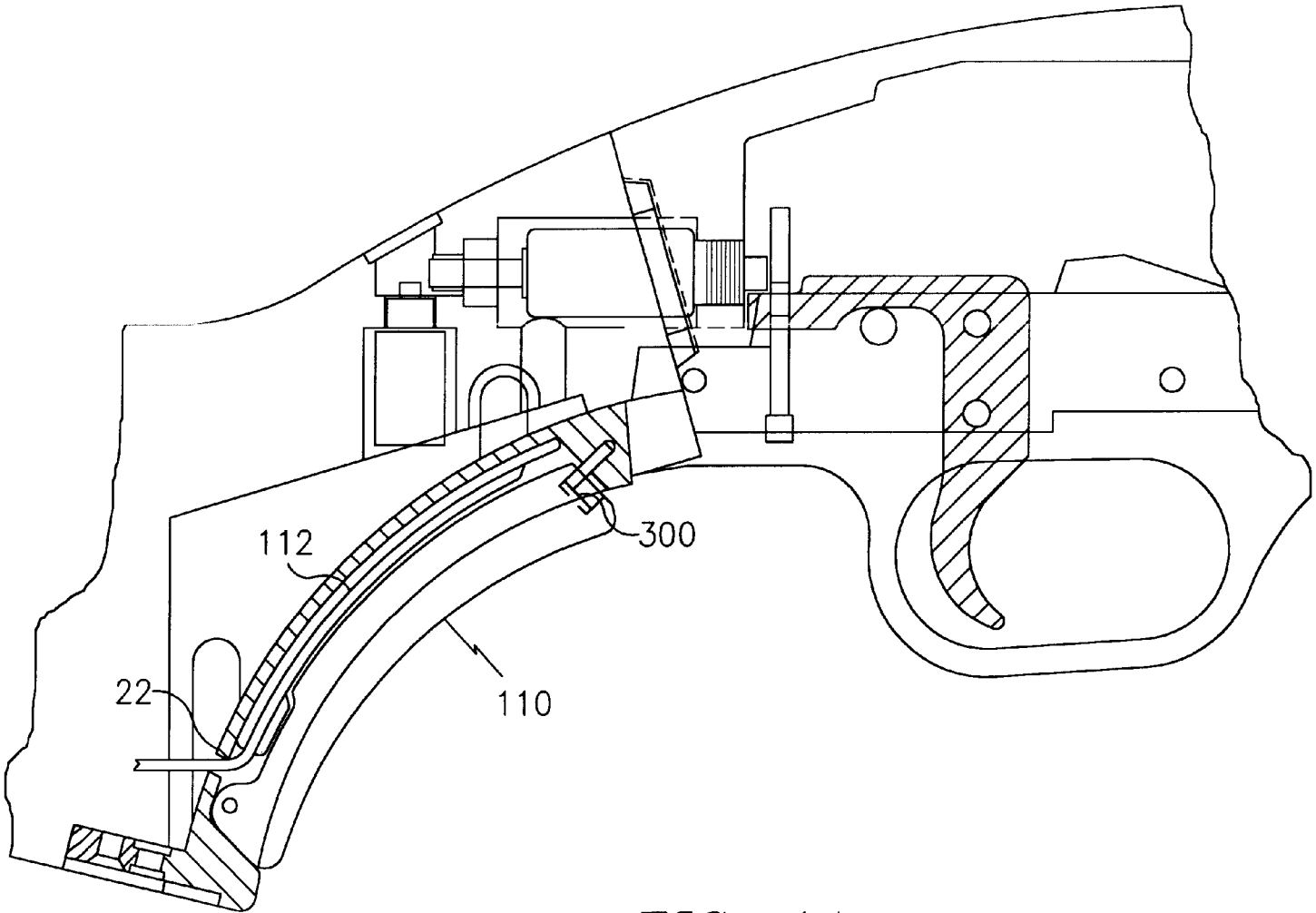
FIG. 11 is a schematic side section view of a second grip lever and switch arrangement according to the present invention.

In FIG. 10, the grip 22 is provided with the grip switch lever 110 built therein. A lower end of the grip lever 110 is pivotally mounted to the grip via a pin 301, which could also be provided as a hinge or the like. The grip lever 110 is free to pivot about the pin, but only to the extent permitted by a travel limit pin or tab 300, which extends from the grip into an upper end of the grip lever 110. An extension tab portion 302 of the grip lever extends rearwardly to contact the grip switch 112, which is internal to the grip 22. Here, the grip switch 112 is a standard, spring-lever or push-button actuated microswitch, mounted to the grip 22 via a mounting bracket 303. When a user engages the grip 22, the grip lever is depressed, pivots about the pin 301, and the switch is thrown, indicating the presence of a potentially authorized user. A spring element (not shown) may be employed to bias the lever away from the switch, whereby if a user releases the grip the switch is thrown and the gun deactivated until the grip lever is again depressed. The embodiment of FIG. 11 is similar, except that a tape switch is used instead of a microswitch. With both the embodiments of FIGS. 10 and 11, it is preferable that the amount of grip lever travel necessary to activate the grip switch be minimized. This ensures that the "feel" of the firearm will not be significantly altered by the addition of the grip lever.

Also shown in FIGS. 1 and 2 is a view window 122 by which the position of the preventing mechanism 40, whether prevented or unblocked, may be observed by the individual user 12. The window 122 may be a durable, clear plastic plug by which preventer mechanism is sealed from outside tampering, while permitting the user to observe the position of blocker rod 42. It has been found that when the preventer mechanism 40 comprises an electromechanical solenoid 50, activation of the solenoid 50 to an unblocked position also provides an audible click, indicating activation of the firearm to an enabled or ready-to-fire position. The user can visually confirm that the preventer mechanism 40 has moved to an enabled position and may then choose to aim and fire at an intended target.

One unique feature, according to another aspect of the present invention, is an inertia resistant preventer device 124 provided as a part of preventer mechanism 40. The inertia resistant device 124, as shown in the embodiment depicted in FIGS. 1 and 2, comprises a second blocker rod 54 activated by a second solenoid 56 along an axis 58. The second preventer solenoid 56 actuatably holds the second blocker rod 54 positioned for movement between an interference position in which the second blocker rod 54 blocks the movement of the first blocker rod 42 and a retracted position in which the first blocker rod 42 is free to move. The movement axis 58 of the second blocker rod 54 is at an angle (e.g., 90°, as shown) to the movement axis 52 of first rod 42 so that any violent inertial movement of the first rod 42 along it axis 52 will not also cause inertial movement of the second rod 54 along its axis 58. Upon interrogating the surroundings and finding an authorized code which actuates the preventer mechanism 40, both solenoids 50 and 56 will be actuated so that the second blocker rod 54 moves out of the way of the first blocker rod 42 and the safety lever 28 becomes unblocked. In the unlikely yet theoretically possible situation in which the first blocker rod 42 was jarred or otherwise moved along its axis 52 by inertial forces acting in the direction of the axis 52, the same directional change in movement would not also cause the second blocker rod 54 to be moved along its axis 58. Such inertia forces or inertial movement could theoretically be caused by a rapid change in the movement direction of the firearm and the resistance of the mass of rod 42 to the change in movement direction if acting in alignment with the axis 52 and in the direction against the spring 46. Such movement would not simultaneously result at an angle to axis 52 and particularly not at an angle that is approximately at right angles to axis 52. Thus, the second blocker rod 54 secures the first blocker rod 42 against the inadvertent, yet theoretically possible, movement of the first blocker rod 42 to an unblocked position without the presence of an identification device 70 having the authorized identification code.

Also, in such an inertia securing device 124, the second solenoid 56 and its second blocker rod 54 may be smaller and slightly quicker in activating than the first solenoid 50 and its first blocker rod 42. Thus, upon activation of the preventer mechanism 40, the second solenoid 56 reacts first to move the second blocker rod 54 out of the way of the first blocker rod 42. This actuation of the second blocker rod 54 is timed to occur just a fraction of a second before, and possibly only a few milliseconds before, the movement of the second blocker rod 42. Also, instead of selecting a smaller securing solenoid 56 relative to preventer solenoid 50, equal sized solenoids could be used with an appropriate slightly delayed timing circuit to accomplish the same results.

Figure 3:
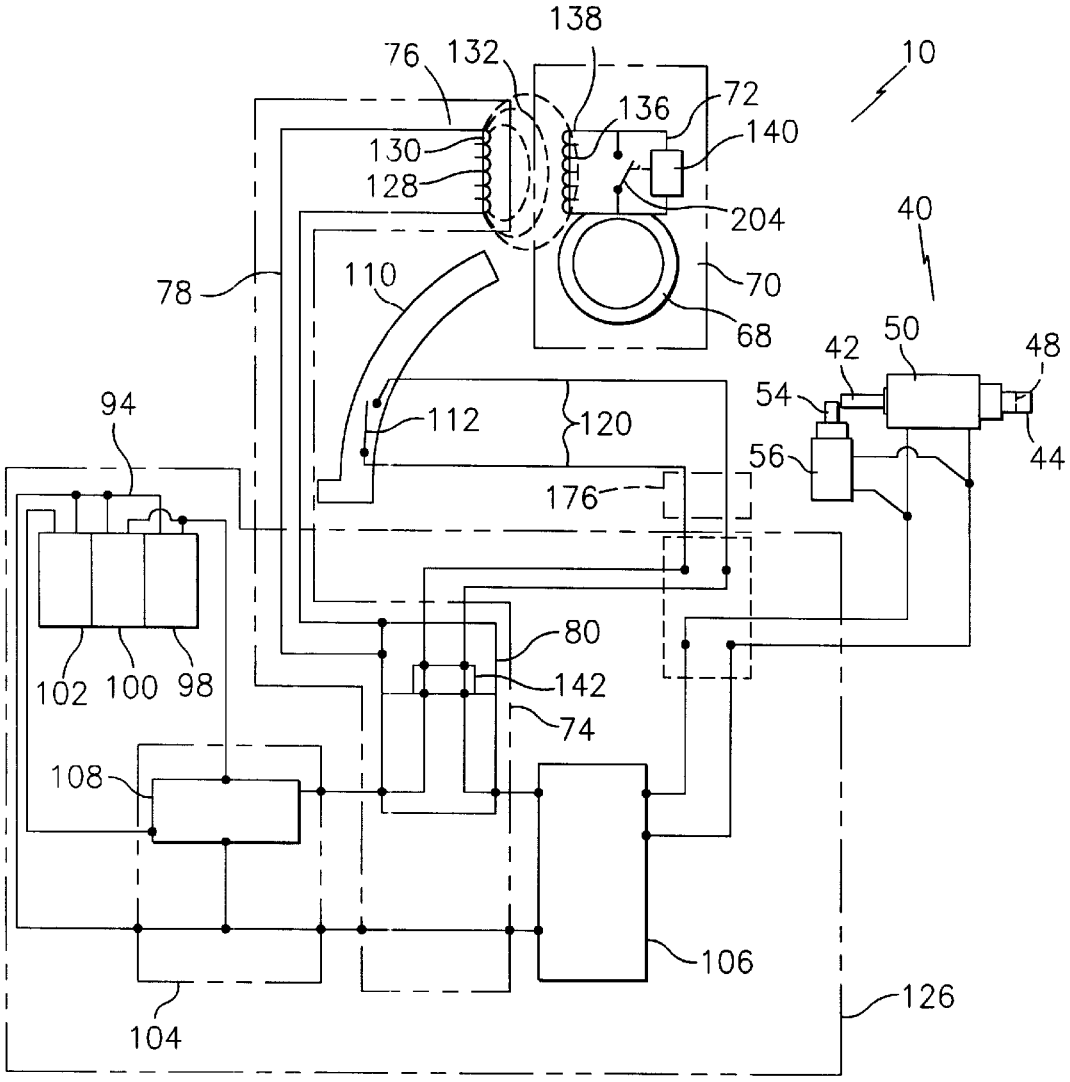
FIG. 3 is a schematic electrical, electromechanical and electromagnetic component diagram of a passive tag safety device and system according to the present invention.

FIG. 3 is a schematic diagram of electrical, electromechanical and electromagnetic components of a passive tag safety device and system according to the present invention. When a user depresses the grip lever 110, the grip switch 112 closes to connect power through the switch circuit 120, thereby activating electrical component circuitry schematically enclosed within circuit box 126. In particular, power is connected from the power source 94 to the interrogation circuit 74 and also through a backup power circuit 104. Note that the preventer mechanism 40 is connected to the circuit 126 via the power conservation circuit 106. The power conservation circuit 106 serves to limit the amount of power necessary to keep the solenoids in place, to provide adequate and controlled driving current to the solenoids (which may require short bursts of significant electrical current to activate), and to protect the rest of the circuit 26 from current overloads or the like. The power conservation circuit is preferably MOSFET based.

As discussed above, backup battery circuit 104 compares the voltage in primary batteries 98 and 100 and if the voltage falls below a predetermined minimum voltage in a range of voltages in which preventer mechanism 40 continues to operate reliably, backup battery 102 will be automatically connected by backup battery circuit 104 to provide power to the interrogation circuit 74. An alarm circuit 108 is also provided by which a periodically repeated human perceivable alarm signal, preferably an audible alarm, such as beeping every one to five minutes, will alert the user to recharge or replace the primary batteries 98 and 100 while the backup battery 102 continues to provide adequate electrical power at a voltage within the predetermined range of voltages in which the preventer mechanism reliably operates. In the preferred embodiment, the backup circuit 104 comprises a comparator circuit by which the voltage in the primary power source 94 is compared to the voltage in the backup battery 102. Whenever the backup battery is connected, the primary source 94 is disconnected from the circuit and the alarm circuit 108 produces the alarm signal, preferably a periodic "beeping" at regular intervals, until the primary batteries are reconnected by the backup battery circuit 104 to the safety enhancement system. It has been found that 9-volt lithium manganese dioxide batteries work well as primary batteries 98 and 100, as well as for the secondary backup battery 102. Also in the embodiment depicted, a solenoid nominally rated for 9-volt actuation operates safely and reliably at least in a range about ten volts down to about six volts. The voltage output from the primary battery varies from its maximum voltage output of above about nine volts and downward as power is used over a long period of firearm use. The minimum voltage at which the backup battery is engaged is selected at about seven volts (i.e., within the reliable range for the preventer mechanism) to facilitate reliable operation in systems both before and after the backup circuit switches batteries. It has further been found that after a period of disconnection, the primary batteries may self-regenerate to a certain extent. When they self-regenerate to a voltage above about seven volts, the backup battery will be disengaged from the system by the backup circuit 104 and the primary batteries will again be connected to the system. With this backup battery and backup battery circuit, it has been found that, after the "battery low" warning signal is first given, the warning beep will continue for a period of time and subsequently will stop after the primary batteries regenerate, thereby avoiding some of the annoyance of an incessant beeping. Nevertheless, the user will have been warned to replace the batteries, and after a short period of additional usage, will be reminded to replace the primary batteries. The additional usage will reduces the voltage in the primary batteries and the primary batteries will again be automatically disconnected by the backup circuit, the backup battery will again be connected, and the alarm will be reinitiated.

With adequate power supplied to the interrogation circuit 74, because of the closing of the grip switch 112, a power signal-generating circuit 80 will produce a sinusoidal low frequency to a power signal transmitter 76. As will be discussed more fully below, the power signal transmitter 76, in the embodiment shown, comprises a magnetic coil having a coil 128 made of transformer wire wound around a magnetic core 130°. The core is preferably made from a magnetic material having low hysteresis characteristics. Many such materials are manufactured by Fair-Rite Corporation of Wallkill, N.Y. The oscillating electrical signal in conductor 78 causes a reversing magnetic field 132. The rise, collapse and reversal of the magnetic field 132 will occur at a rate and with a magnitude, corresponding to the sinusoidal voltage in conductor 78. Thus, in a preferred embodiment, the sinusoidal electrical signal in conductor 78 has a frequency of about 125 kHz, and similarly produces the magnetic field 132 that rises to a maximum level and reverses through zero to the same reversed polarity intensity at a fixed frequency of 125 kHz. The field 132 emanates through and into the surrounding proximity. The personal identification device 70, having a passive tag 72 thereon in the embodiment depicted, comprises a secondary magnetic receiving coil 134 that includes a coil of transformer wire 136 and a magnetic core 138. The close proximity of the transmitter 76 and the passive tag 72 effectively creates a loose coupled transformer by which power from the primary coil 128 is induced into the secondary coil 136. Thus, a power signal is received and the passive tag circuitry 140 of the passive tag 72 is energized. Once energized, the circuit 140, which has an embedded code, acts to return a signal from its coil 136 to the primary coil 128. The returned analog electrical signal is then carried through the conductor 78, converted to a digital code signal using operating amplifiers, and read in reader circuit 80 to determine whether it matches a prerecorded authorized code stored in a register or memory area 142 of the circuit 80.

Figures 6, 7:
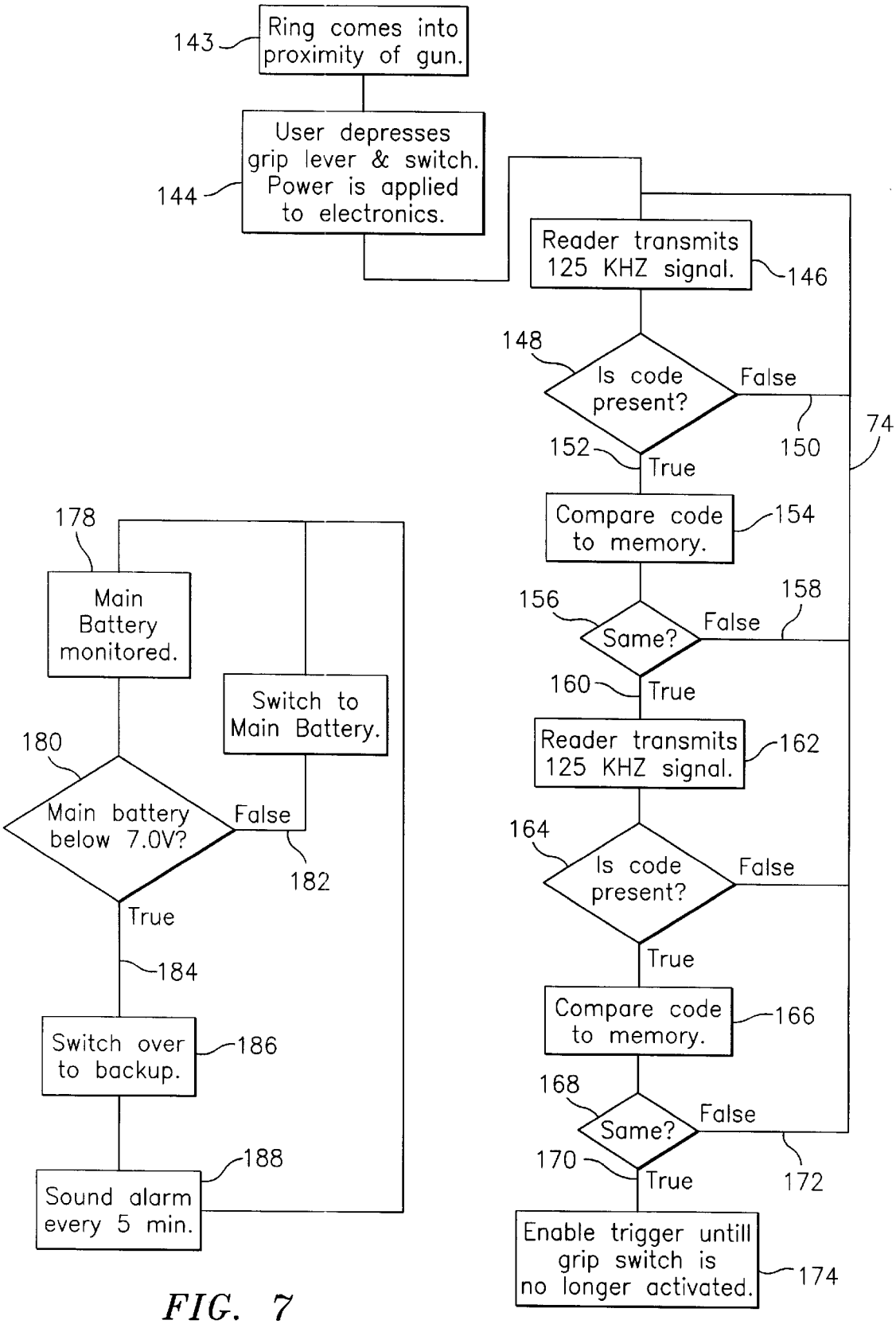
FIG. 6 is a schematic flow chart of a reader circuit according to the one aspect of the present invention.
FIG. 7 is a schematic flow chart of the logic of the battery backup circuit according to one aspect of the present invention.

Upon activation of the grip switch 112, and in the presence of an authorized code in close proximity to the firearm, the time to activate the preventer 40 and thereby allow conscious firing by the authorized user is less than a second. The interrogation transmission of a power signal, the activation of the coded tag, the sending of a return signal and the activation of preventer mechanism 40 all occur within a fraction of a second. The interrogation flow diagram of FIG. 6 schematically depicts the process. According to the process, at step box 143 the passive identification device 70 comes into close proximity to the firearm 20. As indicated in stop box 144, at the same time the rings come into the proximity of the gun, the user grips the grip lever 110. This causes the grip switch 112 to close and power is supplied to the electronic circuit 126. According to step box 146, the interrogation circuit transmits a power signal. If a coded device is present, as indicated in question box 148, the power signal will be received by the passive tag which will return a coded signal to the reader circuit 80. If no signal is returned to the reader, the interrogation signal will simply continue to be re- transmitted again and again as long as the grip switch remains closed, as indicated by the return loop 150. In the event that a coded signal is returned, branch 152 of the flow diagram is followed and the code will be compared at step box 154 to the code in the memory 142 of the reader 80. If the code is not the same, then question box 156 and flow path 158 will indicate that the power signal is to be continued as long as the grip switch 112 is closed. If the code of the return signal is the same as the stored code as indicated at flow path 160, the reader 80 again transmits a signal, as indicated at 162, in order to confirm both the presence of a code and to compare the code to the authorized code. Thus, in steps 164, 166 and 168, the interrogation process described above with respect to steps and questions 146, 148, 154 and 156 are repeated and, only if the authorized code is confirmed as being the same as the stored code, will the system enable the trigger by providing the power to unblock the preventer 40. The trigger will be enabled until the grip switch is no longer depressed or activated. The entire process depicted in FIG. 6 takes less than about one-third of one second, so that depressing the grip lever and placing a ring 68 having a passive tag 72 with the authorized code embedded in it in proximity of the gun will almost immediately enable the firearm in much less time than it will normally take an individual to consciously pull the trigger.

Figure 4:
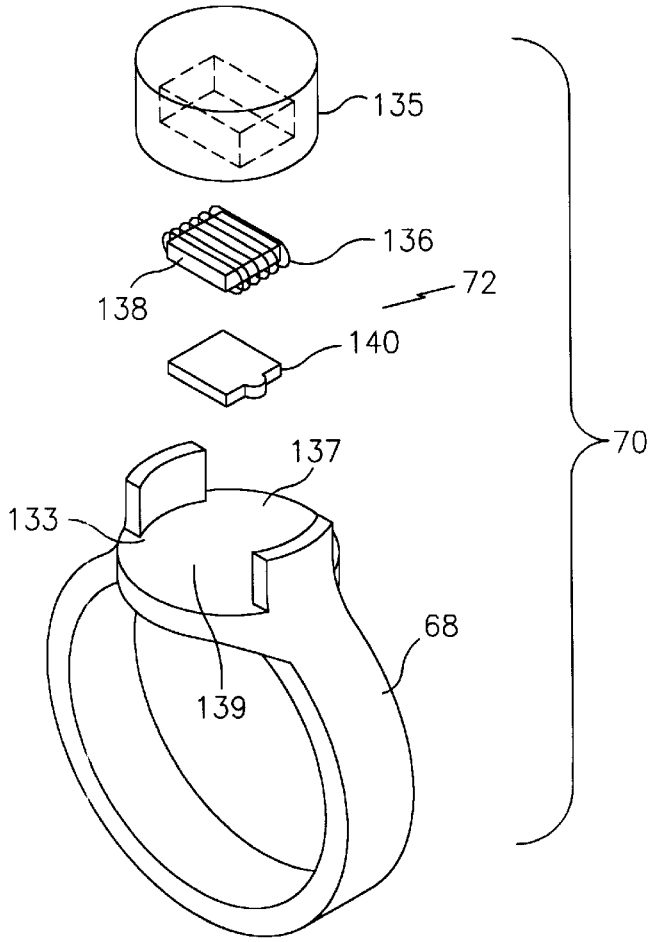
FIG. 4 is an assembly view of one embodiment of a passive tag personal adornment, and, in particular, a finger ring, showing a passive tag assembled into the personal adornment according to one aspect of the present invention.

FIG. 4 is a schematic perspective view of a personal identification device 70 according to one embodiment of the invention. In this embodiment the finger ring 68 includes a collet 133 provided on the ring 68 for holding the passive magnetic tag 72 including the coil 136, the magnetic core 138, and the passive tag circuit 140. The entire passive tag 72, coil 136 and circuitry 140 may be encased in a nonmetallic and preferably a durable polymeric ornament 135 that securely encases and rigidly holds the passive tap, 72, preferably in a moisture-sealed casing. Uniquely, according to the embodiment depicted in FIG. 4, in which the passive tag comprises a magnetic coil 136 and magnetic core 138, side openings 139 and 137 are provided for alignment with the poles of the coil 136 and the core 138. This allows the magnetic field of the power signal from the powered transmitter 76 (and from coil 128) to be received by passive tag 72 (and its coil 136) without metallic blocking by any portion of the personal adornment ring 68.

Figure 5:
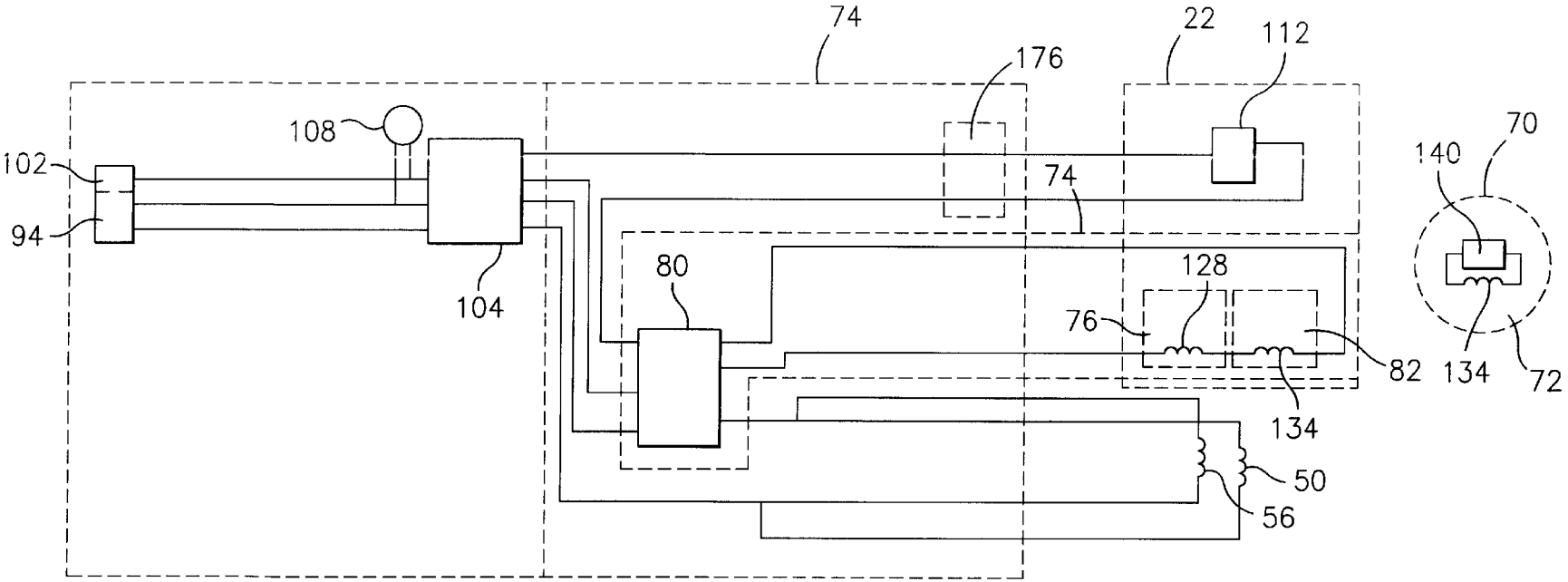
FIG. 5 is a schematic electrical circuit diagram of an electrical activation circuit including a switch, a primary power transmission coil, a secondary passive tag coil and a preventer mechanism according to one aspect of the present invention.

The detailed schematic electrical component diagram of FIG. 5 depicts additional details and, in particular, with respect to power transmitter and reader circuit 80, a first power transmitter 76 with an antenna 128. As described previously, the antenna 128 is preferably a coil and magnetic core. FIG. 5 also depicts a second power signal transmitter 82 with a second power transmitting and signal receiving antenna or coil 134. In the preferred embodiment, both coils 128 and 134 transmit a power signal simultaneously at spaced-apart positions from inside the grip 22 of the firearm 20. It has been found that for a normal grip of a firearm traversing approximately three to five inches, two signal transmitters that are centrally located at positions about one to about two inches apart provide good power signal coverage of the grip area. Each transmitter coil 128 and 134 may be provided with power transmitting signals that are sufficiently strong, at distances up to about three to six inches, to give good close proximity power transmission and backscatter signal receiving capability for a passive tag designed to be contained in a finger ring.

Also advantageously, because the transmission distance at which adequate power is provided to a passive tag is small, the preventer is moved from its preventing position only when the passive tag is in close proximity to the firearm. This feature may be seen as redundant in an embodiment in which a proximity switch such as the grip switch 112 is used. However, in an embodiment in which the grip switch 112 is not used, as, for example, in an embodiment where a timer circuit 176 periodically energizes the power signal generator and transmitter to send an interrogation signal at regular time-spaced intervals, the firearm preventing mechanism will still only be activated to a firing position when the passive tag is in close proximity to the firearm. In such an alternative embodiment, the operational proximity is determined by the effective power signal transmission and backscatter reception distance. Again, this distance is desirably small, preferably less than about one foot for additional safety of the authorized user. Thus, by way of example, a timing circuit 176 might be used in place of the grip switch 112 to periodically activate interrogation circuit 74. Because a short burst of transmitted power for a short period of a few milliseconds would be sufficient to activate a passive tag to send a returned signal, periodic inquiry power transmission signals could be generated at regular periodic intervals of less than a few seconds each without rapidly depleting the power source. Thus, the use of the grip switch 112 in combination with the grip lever 110 has certain advantages in requiring close proximity, and further, by providing excellent power conservation, but, as described, the timing circuit 176 may be used instead FIG. 7 shows a schematic logic diagram for the backup battery circuit 104 that is also shown in FIGS. 3 and 5. The logical steps of operation of the backup circuit 104 include monitoring the battery at step 178. An inquiry is made at step 180 to determine whether the voltage of the primary battery 94 falls below a predetermined voltage such as seven volts. If it has not fallen below seven volts, then the "false" logic path 182 is followed to continue to monitor the battery at step 178. If the voltage in the main battery has fallen below the predetermined voltage, then the "true" path 184 is followed and the circuit 104 acts at step 186 to switch over to the backup battery 102. Also, when it switches over to the backup battery 102, an alarm 108 is sounded. The alarm sound is repeated periodically, as, for example, every five minutes at step 188. The circuit 102 continues to monitor primary battery at step 178 and if the main battery 94 continues to be below seven volts, power to the system remains switched over to the backup battery at step 186 and the alarm continues to sound every five minutes. In the event that, for example, an alkaline battery or a lithium battery is being used, an open circuit to the positive and negative terminals of the battery will, due to natural chemical phenomenon, result in the battery partially recharging itself. Thus, after a period of not being used, during which period the alarm is signaled every five minutes using the backup battery, the primary batteries may recharge themselves to above the predetermined minimum voltage. When step 180 inquires whether the main battery 94 is below seven volts, it receives a "false" indication showing that battery 94 is above the minimum. Circuit 102 then switches over to the main battery 94, at which point the alarm is no longer sounded until such time as the main battery again falls below the minimum voltage.

In another preferred embodiment, the backup battery 102 is connected in parallel with the primary batteries 98, 100 (also in parallel) and acts as a third primary battery (e.g., it no longer acts as a backup battery.) Each of the batteries 98, 100, 102 is approximately 9 volts so as to provide a total of approximately 9 volts for the system. Additionally, although the backup circuit 104 still acts as a comparator circuit to monitor the total output voltage of the batteries, instead of switching to a backup power source, it merely instructs the alarm circuit 108 to sound the alarm when the output voltage falls near the required system voltage (6–7 volts). The alarm should sound before the output voltage of the batteries 98, 100, 102 falls below the required system voltage so that a user may still use the firearm for a period after the alarm sounds.

These three combined batteries 98, 100, 102 provide an overall longer battery life than two batteries with a backup. However, the backup system as described above may still be provided. Of course, it is possible to provide three primary batteries and a backup battery along with a switching backup circuit 104 to get the benefits of both preferred embodiments. However, space constraints in the firearm's stock and weight considerations for those having to carry the firearm over potentially long distances (e.g., while hunting) make this option unattractive, if possible at all.

In further regards to the electronic circuit 126, when a user actuates the grip switch 112, the interrogatory circuit 74 draws current to cause a power signal to be generated by signal generator 76 and to be transmitted from the power transmitter coil 128, as discussed above. Subsequently, the reader circuit 80 recognizes a code received from the passive tag 72 and verifies it as an authorized code corresponding to the code recorded in the memory of reader 80. Then, electrical power is provided to the preventer mechanism 40 and the power is provided to solenoids 50 and 56. Subsequently, the current to the solenoids is preferably dropped, using power conserving circuit 106, to a maintenance current level. When the preventer 40 is turned on, the system fully actuates the preventer mechanism to an unblocked position, including moving solenoids 50 and 56. When the preventing rods in the solenoids have been moved, the amount of power required to maintain the preventing rods in unblocked positions against the biasing spring 46 is significantly less. The power is uniquely dropped by the power conservation circuit 106. Thus, the amount of power drained is significantly reduced and, under normal circumstances, continues to be reduced to conserve power. It has been found when the lower maintenance power is provided, inadvertent jarring of the firearm may, in certain situations, cause one of the preventing rods to move from its maintained unblocked position to a blocked position. In these instances, the maintenance power might not be sufficient to reactivate the preventer to its unblocked position. Correspondingly, the conservation circuit 106 may be designed, according to one aspect of the invention, to periodically provide a high energy pulse. The pulse would have a short duration and periodic short, high energy pulses are provided thereafter.

Figure 8:
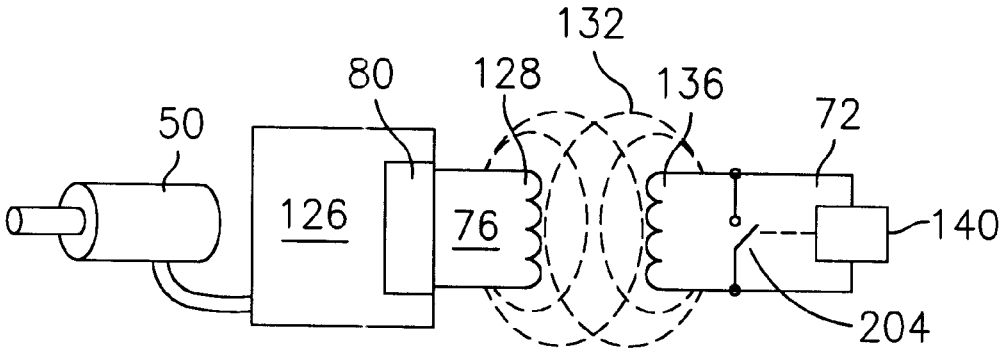
FIG. 8 is a schematic depiction of a loose coupled primary power transmission coil and a passive tag secondary coil, with magnetic coupling flux lines schematically represented as phantom lines therebetween.

FIG. 8 schematically depicts a firearm safety device and system for converting an existing firearm. The device and system include a solenoid 50 for blocking and unblocking the trigger, an electronic circuit module 126, a power signal transmitter 76 and a passive tag 72. The transmitted signal is schematically shown by curved lines 132 to represent an electromagnetic pulse wave. The signal 132 is preferably provided at a fixed frequency selected in a range less than about 20 MHz. This range is below the range typically known as radio frequency and is down in the range more typically characterized as a magnetic frequency. It has been found desirable to select a fixed frequency of 125 kHz or 13.6 MHz to take advantage of existing electromagnetic tag circuitry available from manufactures of such devices such as from Microchip Technologies, Inc. The electronic circuit module 126 passes an oscillating voltage through coil 128. For example, approximately 200 peak volts at a current of about 500 to 600 milliamps oscillating in a sine wave at a frequency of 25 kHz, works well. Because the voltage through coil 128 is cyclic, the magnetic field pulse 132 reverses at the same cyclical frequency. Coil 128 acts as a primary coil of a transformer and coil 136 of tag 72 acts as a secondary coil. The coded signal returned to the reader 80 is accomplished by embedded circuit 140 that activates a partial shunt or short circuit, preferably a transistor 204, schematically represented as a shunting switch 204 by which a load is placed on the secondary coil 136. The shunt draws inductive power and causes a corresponding decrease in the power in the primary transmitter coil 128, thereby dropping the peak voltage across coil 128 for a period of time corresponding to the time the shunt 204 is activated by circuit 140. Thus, according to a theory known as electromagnetic backscatter, the tag 72 is designed to transmit a coded signal carried back to reader 80 on the same transmitted power signal 132. The power signal 132 becomes a carrier signal for the return transmission from tag 72 corresponding to the personal identification code embedded in circuit 140. Such passive tags have been specially designed according to the present invention to operate in the combination firearm safety system. The transmitter coil 128 and the receiver coil 136 have been designed with appropriate inductance and provided with appropriate capacitance for "tuning" the transmission, the reception and the return signal transmission via back-scattering.

Although passive tags energized by time-varying electromagnetic waves are sometimes referred to as radio frequency identification systems, the system, according to the preferred embodiment, does not use radio frequency but rather uses a much lower electromagnetic frequency. In a normal radio reception system a much higher "radio frequency" is used for various purposes according to prior wisdom. For example, a radio receiving antenna would be designed to have a length equal to a multiple or an even fraction of the signal wave length and at least one-quarter of the wave length of the radio signal so that proper resonance tuning can be accomplished at the receiving antenna. Thus, radio reception of a signal with a frequency of 125 kHz would require an antenna about 1900 feet long, more than one forth of a mile long and much longer than any antenna that could practically be placed in a finger ring or another personal adornment of a reasonable size. Therefore, those proposing radio transmitters and transceivers for firearm personal identification devices, have generally proposed much higher frequencies in the high megahertz range, more than about 500 MHz, and into the gigahertz range. Such devices also typically included power supplies both in the firearm and in the personal identification radio transducer or transceiver carried by or on the person of the user. Those radio frequency identification systems for firearms have typically used devices to carry a radio transducer that have been larger than a conveniently carried personal adornment and much larger than a finger ring. Also, as discussed above, radio devices have a range of at least several feet, such that a firearm could still be used against the authorized user who might be sufficiently close to the perpetrator to be injured by his or her own firearm.

The passive tag system basically comprises an interrogator, a power transmitter, a passive tag circuit for receiving energy from the interrogator, a secondary coil antenna for returning a coded signal, a reader circuit including programmable memory for storing the authorized code, and an activation circuit for appropriately turning on the system to unblock the firing mechanism. The tag 72 comprises an antenna coil, and a silicon chip that includes basic modulation circuitry and non-volatile memory. The tag is energized by the time-varying electromagnetic power signal wave that is transmitted by the transmitter coil of the reader. The electromagnetic power circuit not only supplies power to the basic modulation circuitry of the silicone chip, but also acts as a carrier signal. When the electromagnetic field passes through the secondary antenna coil of the tag, there is an AC voltage generated across the coil. This voltage is appropriately rectified in the circuit 140 to supply power to the tag. The information stored in the non-latile volatile memory of the tag is transmitted back to the transmitter coil and to the reader circuit using a phenomenon known as backscattering. By detecting the backscattering signal, the reader circuit receives the information stored in the tag so that the tag can be fully identified according to the preprogrammed code stored in its non-volatile memory. The reader circuit typically comprises a micro-controller-based unit with a wound transmitter coil, a peak detector circuit, comparators and firmware designed to transmit energy to the tag and to read information back from the tag by detecting the back-scatter modulation. The tag is a magnetic frequency identification device incorporating a silicon memory chip, usually with an onboard rectification bridge and other front-end signal receiving devices, a wound or printed secondary antenna coil, and, at the low frequencies proposed, a tuning capacitor that appropriately matches the inductance of the transmitting coil to the inductance of the receiving coil. The transmitted power signal is in the form of an electromagnetic sign wave generated by the transmitter circuit to transmit energy to the tag and a reader circuit receives data from the tag. It is typical in passive tag technology to have frequencies of 125 kHz or 13.56 megahertz. In the present embodiment, 125 kHz is preferred. True radio frequencies higher than the kilohertz and low megahertz range may be used for radio frequency identification tagging, but the communication methods are somewhat different. Thus, for example, frequencies higher than about 500 MHz or frequencies in the gigahertz range must use true radio frequency linking that requires tuning the transceiver antenna to a multiple, or a fraction not less than one-fourth, of the wave length of the radio frequency signal. Certain aspects of the invention may be beneficially used with such radio frequency devices. For example, the battery backup and backup battery circuit, the inertia resistant preventer mechanism, and the power conservation circuitry solve problems faced by others. Nevertheless, the advantages of using electromagnetic signals having frequencies of about 125 kHz and 13.56 kHz and beneficially utilizing a transformer-type electromagnetic coupling in the firearm safety enhancement system and device is also a significant development.

The term "backscatter modulation" refers to periodic fluctuations in the amplitude of the power transmission signal. It also acts as the return carrier signal to transmit data back from the tag to the reader. This system may seem unusual to those attempting to apply typical radio frequency or microwave system transceivers. In the system according to the preferred embodiment of the present invention, there is only one transmitter—it is carried in the firearm. The passive tag that is mounted in the personal identification device is not a transmitter or a transponder, as it does not have its own power supply and does not produce a separate signal, yet bidirectional communication takes place through the backscatter phenomena. The electromagnetic field generated by the tag reader and energy transmitter has the purposes of inducing enough power into the tag coil to energize the tag; it also provides a synchronized clock source to the tag and it acts as a carrier for return data from the tag. The passive tags that are electromagnetic devices according to the preferred embodiment of the present invention, have no battery or power source. They derive all their power for operation via electromagnetic induction from the power signal generated by the power signal generator in the reader. The induction operates at close range. As discussed above, the close-range operation has been determined to be advantageous for the purposes of a gun safety device and system. The circuit 140 of the passive tag also has a divider circuit which uses the fixed frequency of the power signal for purposes of timing the return data transmission information bit rate. It has been found that an onboard oscillator and the space required for it are not as advantageous where the small size of the ring contribute to the success of the invention.

The backscatter modulation described above is accomplished with a modulation detection circuit in the reader circuit 80 by which differences in peak voltage of the power signal is detected and converted into coded information. The power signal is a sine wave having a predetermined amplitude. This signal is monitored to determine whether any changes in the voltage are detected across the transmission coil. Detection of modulations will indicate that a readable identification tag may be present. If the tag is present and is producing backscatter modulation, then it indicates that the tag has received sufficient energy to operate. Once the circuit begins operating, it uses the power transmission signal frequency as a clock to begin the transmission of data in the form of periodic shunts by means of turning a transistor on and off. The transistor is connected across the terminals of the secondary coil in the tag unit. Thus, data in the tag unit is initiated and is transmitted at a desired rate, changing the amplitude of the voltage across the power transmission coil. By monitoring the modulation, the reader circuit, using a combination of operational amplifiers, converts the modulation into digital information, i.e., analog data is converted into bits of information or a binary code. The binary code is compared to the stored authorized user code and, if it matches, then power is transmitted to the solenoids to unblock the firing mechanism of the firearm. The data is encoded in terms of ones and zeros. The coded information might be transferred back using a direct modulation, wherein high amplitude indicates a one and a low amplitude indicates a zero. Direct modulatory systems are subject to interference and, even though they have the advantage of a fast data rate, the accuracy of a code is important for the present invention. In the present invention, it has been found preferable to use a frequency shift keying (FSK) data modulation by which the data is transmitted in terms of zeros and ones, in which the zero indicates one frequency of modulation and the one is indicated by another frequency or a shifted frequency of modulation. Thus, for example, the 125 kHz cycles might be shunted for four cycles and unshunted for four cycles, with a total of eight cycles indicating a binary zero. The 125 kHz signal could then be shunted for shunting five cycles and unshunted for five cycles, a total of ten cycles, indicating a binary one. Thus, a modulated return signal having a frequency of 125 kHz divided by eight represents a zero, and a frequency of 125 kHz divided by ten equals one.

Figure 9:
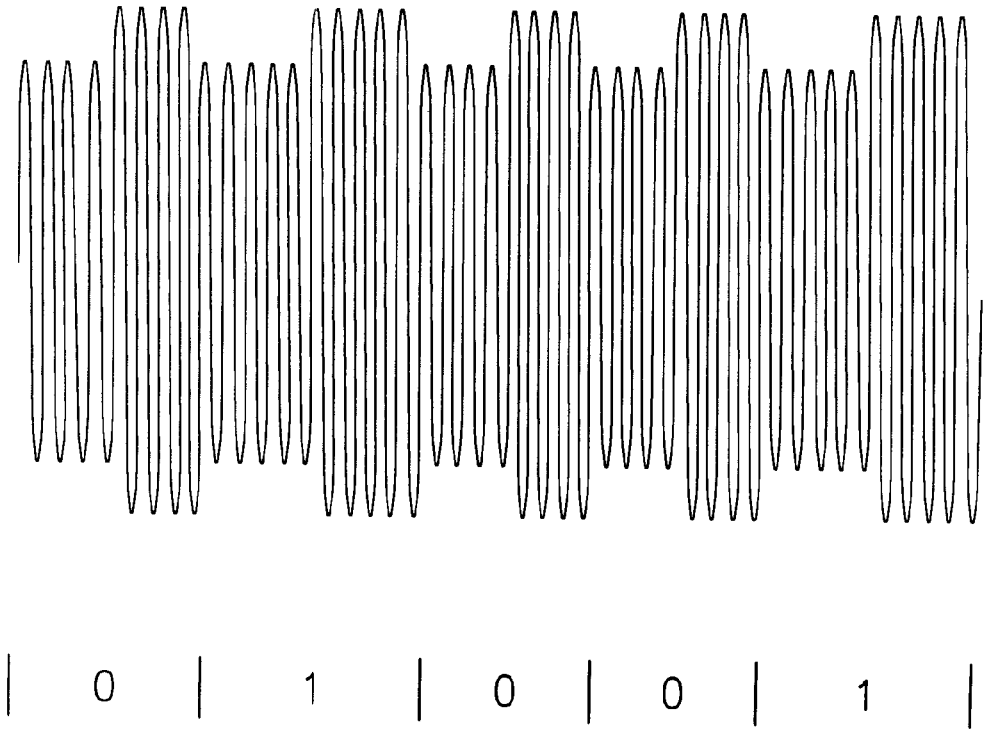
FIG. 9 is a schematic graphical representation of a portion of a magnetic power signal from the primary coil with a coded identification signal superimposed on the primary coil by timed, partial shunting of the secondary coil according to prerecorded, coded identification signal.

FIG. 9 schematically depicts a series of ones and zeros imposed via backscatter on a power transmission signal according to the FSK modulation used in the present invention. FSK is advantageous for use with the present invention because the number of combinations of ones and zeros, i.e., the total number of bits of information stored in a very small microchip might easily be 96 bits. Even using four bits of information for each number in a personal identification code and also using a start bit and a parity bit, the 96 bits can easily represent $22^8$ of possible combinations of numbers for the separate personal identification code stored in the passive tag. Transmission of 96 bits of information, even at a reduced frequency of 125÷10 (i.e., 12.5) kHz will nevertheless return the entire 96 bits of stored information in a mere fraction of a second. The transmission of data is accurate and resistant to interference. The fraction of a second time delay between bringing the ring into contact with the firearm and actuation of the preventer mechanism to an unblocked position is of little or no consequence to the user of the firearm. It takes much longer to squeeze the trigger, even if the firearm is already raised and aimed.

Although the firearm safety system of the present invention has been illustrated as being provided in a long gun or rifle, one of ordinary skill in the art will appreciate that it could be implemented in a handgun without departing from the spirit and scope of the invention. Specifically, obvious changes in size or configuration could be made to the components of the system so that they would work properly in a handgun. For example, since most firearms and handguns have different firing mechanisms, the preventer mechanism would have to sized or positioned accordingly. Also, the power supply system would have to be sized to fit within the smaller handgun grip.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A method of preventing a firing mechanism of a firearm from being activated unless an authorized user is using the firearm comprising the steps of:

a. normally positioning a first blocker mechanism to prevent the firing mechanism from being activated;

b. normally positioning a second blocker mechanism to prevent the first blocker mechanism from inadvertently allowing the firing mechanism to be activatable as a result of inertia and relative movement of the firearm;

c. determining if an authorized user is using the firearm; and d. positioning the first blocker mechanism and the second blocker mechanism to allow the firing mechanism to be activatable if an authorized user is found to be using the firearm.

2. The method of preventing a firing mechanism of a firearm from being activated unless an authorized user is using the firearm of claim 1 wherein step c. comprises the sub-steps of:

(i) interrogating an area in proximity to the firearm;

(ii) obtaining a user code stored in a personal identification device carried in a personal adornment by a user if the personal identification device is proximate the firearm; and (iii) comparing the user code to a stored authorization code, with a match between the user code and the stored authorization code indicating that the user is authorized to use the firearm.

3. An inertia-resistant preventer mechanism for use in a firearm safety enhancement system to selectively and controllably prevent a firing mechanism of a firearm from activating, the inertia-resistant preventer mechanism comprising:

a. a first solenoid having a moveable blocking rod with a first actuation response speed, the blocking rod being normally interposed to prevent activation of the firing mechanism and selectably actuatable to allow activation of the firing mechanism; and b. a second solenoid having a second blocking rod with a second actuation response speed at least as fast as the response speed of the first solenoid, the second blocking rod of the second solenoid being normally interposed at an angle to the first solenoid to interfere with the first blocking rod of the first solenoid to prevent accidental movement of the first blocking rod caused by inertia and relative movement of the firearm, and the second blocking rod being selectably actuatable, substantially simultaneously with, or prior to, actuation of the first blocking rod, to not interfere with the first blocking rod of the first solenoid to allow the firing mechanism of the firearm to activate.

4. The inertia resistant preventer mechanism for use in a firearm safety enhancement system of claim 3 wherein the moveable blocking rod of the first solenoid is positioned at substantially a right angle to the second blocking rod of the second solenoid.

5. An inertia-resistant preventer mechanism for use in a firearm safety enhancement system to selectively and controllably prevent a firing mechanism of a firearm from activating, the inertia-resistant preventer mechanism comprising:

a. a first controllably movable blocker normally positioned to prevent the firearm from being activated; and b. a second controllably movable blocker normally positioned to prevent the first controllably movable blocker from being moved by inertia or relative movement of the firearm away from the first blocker's normal position.

6. An inertia-resistant preventer mechanism for use in a firearm safety enhancement system to selectively and controllably prevent a firing mechanism of a firearm from activating, the inertia-resistant preventer mechanism comprising:

a. a first solenoid having a first moveable blocking rod, the first solenoid being actuatable to move the first blocking rod between a safety position preventing the firing mechanism from being activated and a firing position allowing the firing mechanism to be activated; and b. a second solenoid having a second blocking rod, the second locking rod of the second solenoid being interposed at an angle to the first solenoid, and the second solenoid being actuatable to move the second blocking rod between an interference position preventing the first blocking rod of the first solenoid from moving to the firing position as a result of inertia and relative movement of the firearm, and a retracted position allowing the first blocking rod of the first solenoid to move to the firing position.

7. The inertia preventer mechanism of claim 6 wherein:

a. the first blocking rod is normally in the safety position unless the first solenoid is actuated to move the first blocking rod to the firing position; and b. the second blocking rod is normally in the interference position unless the second solenoid is actuated to move the second blocking rod to the retracted position.

8. The inertia preventer mechanism of claim 6 wherein the first blocking rod has a first actuation response speed, and the second blocking rod has a second actuation response speed at least as fast as the response speed of the first blocking rod, whereby when the first blocker rod is in the safety position and the second blocker rod is in interference position the first solenoid and the second solenoid may be actuated at the same time with the second blocker rod thereby moving to the retracted position at least as soon as the first solenoid moves to the firing position to permit activation of the firing mechanism.

9. The inertia resistant preventer mechanism for use in a firearm safety enhancement system of claim 6 wherein the moveable first blocking rod of the first solenoid is positioned at substantially a right angle to the second blocking rod of the second solenoid.

10. The inertia resistant preventer mechanism of claim 6 further comprising an electrical activation circuit, electrically connected to the first solenoid and the second solenoid, for actuating, when an authorized user is proximate the firearm, the second solenoid to move the second blocking rod to the retracted position and the first solenoid to move the first blocking rod to the firing position, and for actuating, when no authorized user is proximate the firearm, the first solenoid to move the first blocking rod to the safety position and the second solenoid to move the second blocking rod to the interference position.

11. The inertia resistant preventer mechanism of claim 10 further comprising at least one system switch mounted in the firearm and electrically connected to the electrical activation circuit, the electrical activation circuit only actuating the second solenoid to move the second blocking rod to the retracted position and the first solenoid to move the first blocking rod to the firing position when the system switch is thrown by a user of the firearm.

12. The inertia resistant preventer mechanism of claim 11 wherein the system switch is a grip switch located in a grip of the firearm, the grip switch being thrown by a user when the user grasps the grip of the firearm.

13. The inertia-resistant preventer mechanism for use in a firearm safety enhancement system of claim 6 further comprising:

a. a selectable activation device including an interrogator circuit for interrogating the area in proximity to the firearm for a coded personal identification device, a coded signal return device carried in a personal adornment by an authorized user, and a decoder circuit coupled to the interrogator device for reading the coded signal and comparing the signal to a stored authorization code; and b. an electrical activation circuit, powered by a portable battery supply in the firearm and electrically connected to the inertia-resistant preventer mechanism for unblocking the firing mechanism of the firearm only when an authorized personal identification code is detected in the coded signal from the coded signal return device.

14. The inertia-resistant preventer mechanism for use in a firearm safety enhancement system of claim 6 wherein the firearm is a shoulder-mounted firearm.

15. The inertia-resistant preventer mechanism for use in a firearm safety enhancement system of claim 14 wherein the shoulder-mounted firearm is a shotgun.

16. An inertia-resistant preventer mechanism for use in a firearm safety enhancement system comprising:

a. a first controllable blocker means for selectively preventing a firing mechanism of the firearm from being activated; and b. a second controllable blocker means for selectively preventing the first blocker means from inadvertently allowing, as a result of inertia and relative movement of the firearm, the firing mechanism of the firearm to be activatable.

17. An inertia-resistant preventer mechanism for use in a firearm safety enhancement system comprising:

a. a first controllable blocking element positioning means for selectively positioning a first blocking element at one of a safety position preventing a firing mechanism of the firearm from being activated and a firing position allowing the firing mechanism to be activated; and b. a second controllable blocking element positioning means for selectively positioning a second blocking element at one of a retracted position allowing the first blocking element to be positionable at the firing position and an interference position preventing the first blocking element from inadvertently being positioned at the firing position as a result of inertia and relative movement of the firearm.

* * * * *

UNITED STATES PATENT AND TRADEMARK OFFICE

CERTIFICATE OF CORRECTION

PATENT NO. : 6,343,429 B1
DATED : February 5, 2002
INVENTOR(S) : Mossberg et al.

It is certified that error appears in the above-identified patent and that said Letters Patent is hereby corrected as shown below:

Title page,
Item [75], Inventors, change "Delton" to -- Deltona --.

Column 13,
Line 27, change "it" to -- its --.

Column 16,
Line 26, change "tap" to -- tag --.

Column 20,
Line 5, delete "non-latile volatile" and insert -- non-volatile --.

Signed and Sealed this

Fourth Day of June, 2002

*Attest:*

*Attesting Officer*

JAMES E. ROGAN
*Director of the United States Patent and Trademark Office*